US006156843A

United States Patent [19]

Yokota

[11] Patent Number: 6,156,843

[45] Date of Patent: Dec. 5, 2000

[54] THREE PIECE SOLID GOLF BALL

[75] Inventor: Masatoshi Yokota, Fukuchiyama, Japan

[73] Assignee: Sumitomo Rubber Industries, Ltd., Hyogo-ken, Japan

[21] Appl. No.: 09/150,744

[22] Filed: Sep. 10, 1998

[30] Foreign Application Priority Data

Sep. 10, 1997 [JP] Japan ..... 9-264994

[51] Int. Cl.[7] ..... A63B 37/12; C08L 33/02

[52] U.S. Cl. ..... 525/221; 525/196; 525/330.2; 473/373; 473/385; 473/374

[58] Field of Search ..... 525/196, 221, 525/330.2; 473/373, 374, 385

[56] References Cited

FOREIGN PATENT DOCUMENTS 880887 3/1990 Japan .

6-142228 5/1994 Japan .

*Primary Examiner*—David J. Buttner

*Attorney, Agent, or Firm*—Birch, Stewart, Kolasch & Birch, LLP

[57] ABSTRACT

The present invention provides a three piece solid golf ball exhibiting excellent flight performance and goof shot feel when hitting. The three piece solid golf ball comprises a solid core, an inner cover covering the solid core and an outer cover covering the inner cover, wherein the inner cover comprises a base resin and an additive and the base resin comprises at least 10% by weight of an ionomer resin having carboxylic groups of which 10 to 60 mol % is neutralized with alkali metal ion and of which 5 to 30 mol % is neutralized with copper ion, a total mol % of the neutralized carboxylic group being 30 to 70 mol %.

11 Claims, 1 Drawing Sheet

THREE PIECE SOLID GOLF BALL

FIELD OF THE INVENTION

The present invention relates to a three piece solid golf ball. Particularly, it relates to a three piece solid golf ball exhibiting excellent flight performance and good shot feel when hitting.

BACKGROUND OF THE INVENTION

At present, many types of golf balls are commercially available in the world, but those used for tournaments or competitions officially authorized are generally two piece solid golf balls and thread wound golf balls, The two piece solid golf balls are mainly approved by amateur golfers, because they are better in flight performance, durability and cut resistance than the thread wound golf balls. The two piece solid golf balls, however, have defects in shot feel, when hitting, and controllability in comparison with the thread wound golf balls.

Accordingly, there have been many proposals for improving the shot feel or controllability of the two piece solid golf balls, for example Japanese Patent Kokai Publication Hei 6 (1994)-142228 and the like. In order to let shot feel and controllability approach to those of the thread wound golf balls, the proposed solid golf balls adopt a three piece construction having two cover layers, of which an inner cover layer is formed from various cover material. The proposals, however, adversely affect on flight performance or keep it at the level of the conventional two piece solid golf balls. It is still desired to improve all of shot feel, controllability and flight performance.

Japanese Patent Kokai Publication Hei 2 (1990)-88087 proposes that n outer cover is formed from an ionomer resin neutralized with both sodium ion and copper ion, so-called dual ion ionomer resin. However, the dual ion ionomer resin is slightly colored with blue and green because of the presence of copper ion and therefore is not good for the outer cover, because it gives rise to defect in appearance.

OBJECT OF THE INVENTION

An object of the invention is to provide a three piece solid golf ball exhibiting excellent flight performance and good shot feel and not having the above mentioned defects.

SUMMARY OF THE INVENTION

Accordingly, the present invention provides a three piece solid golf ball comprising a solid core, an inner cover covering the solid core and an outer cover covering the inner cover, wherein the inner cover comprises a base resin and an additive, and the base resin comprises at least 10% by weight of an ionomer resin having carboxylic groups of which 10 to 60 mol % is neutralized with alkali metal ion and of which 5 to 30 mol % is neutralized with copper ion, a total mol % of the neutralized carboxylic group being 30 to 70 mol %.

The ionomer resin neutralized with both copper ion and alkali metal ion, hereinafter called as "dual ion ionomer", shows better flight performance than the conventional non-dual ion ionomer. When the dual ion ionomer is employed in the inner cover layer, it provides better flight performance even if one employs softer resin than the conventional non-dual ion ionomer and therefore prolongs the flight distance of the resulting golf ball. The soft ionomer resin also improves shot feel. In addition, since the dual ion ionomer resin is used as the inner cover layer, it does not affect on the ball appearance.

DETAILED DESCRIPTION OF THE INVENTION

Figure 1:
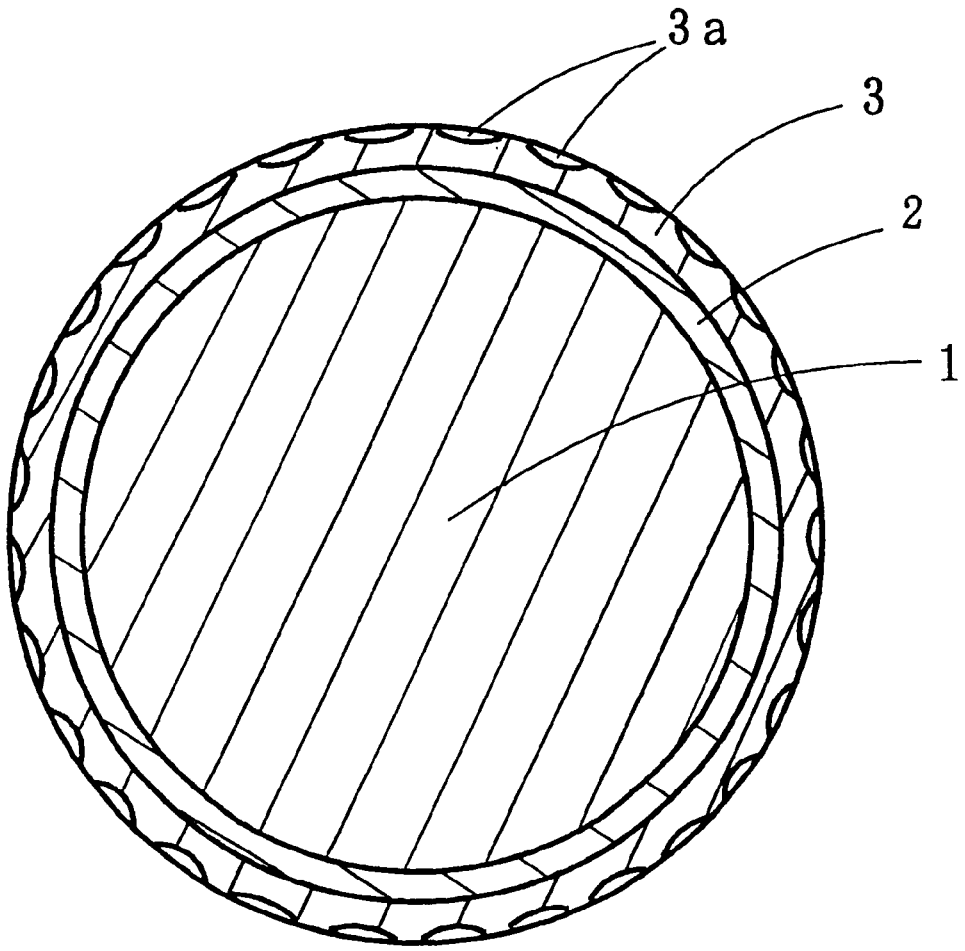
FIG. 1 shows a cross-sectional view of one embodiment of the three piece solid golf ball of the present invention.

The dual ion ionomer resin employed in the present invention is generally prepared from a conventional alkali metal ion-neutralized ionomer by partially neutralizing the remaining free carboxylic acid groups present in the ionomer with copper ion. The preparation of the dual ion ionomer resin is not limited to the above method and it can be obtained by another method.

The alkali metal ion-neutralized ionomer, which is a starting material of the dual ion ionomer, may preferably be a terpolymer of α-olefin, α,β-unsaturated carboxylic acid and α,β-unsaturated carboxylic ester, of which 10 to 60 mol % of carboxylic groups is neutralized with alkaline metal ion.

Examples of the a-olefins are ethylene, propylene, 1 -butene, 1-pentene, 1 -hexene and the like, but preferred is ethylene. The α,β-unsaturated carboxylic acid preferably has 3 to 8 carbon atoms and includes acrylic acid, methacrylic acid, maleic acid or itaconic acid, but preferred are acrylic acid and methacrylic acid. The α,β-unsaturated carboxylic ester may be an ester of the above mentioned α,β-unsaturated carboxylic acid having 3 to 8 carbon atoms (especially acrylic acid or methacrylic acid) and an alcohol having 3 to 9 carbon atoms, and preferred examples thereof are methyl acrylate, ethyl acrylate, propyl acrylate, isobutyl acrylate, n-butyl acrylate, methyl methacrylate, ethyl methacrylate, propyl methacrylate, isobutyl methacrylate, n-butyl methacrylate and the like.

The alkali metal ion for neutralizing the free carboxylic acid groups present on the above copolymer includes lithium ion, potassium ion, sodium ion, cesium ion, rubidium ion and the like. Preferred is sodium ion because of good operability.

The alkali metal ion-neutralized ionomer as explained above is generally commercially available and examples thereof are, if listed by trade names, Hi-Milan 1605 (Na), Hi-Milan 1707 (Na), Hi-Milan MK7320 (K), Hi-Milan 1856 (Na) and Hi-Milan 1555 (Na), all available from Mitsu-Du Pont Chemical Co., Ltd.; Surlyn 8920 (Na), Surlyn 8940 (Na), Surlyn AD 8512 (Na), Surlyn 7930 (Li), Surlyn 7940 (Li), Surlyn AD8265 (Na) and Surlyn AD 8269 (Na), all available from Du Pont Co. in U.S.A.; lotek 8000 (Na) available from Exxon Chemical Co., in U.S.A.; and the like. The letters described in the parentheses, such as Na, K or Li, show sorts of alkali metal ion for neutralization.

The dual ion ionomer may be obtained by adding copper ion source to the above mentioned alkali metal ion-neutralized ionomer resin to neutralize at least a portion of the free carboxylic acid groups remaining in the ionomer resin with copper ion. The copper ion source to be employed includes copper dihydroxide ($Cu(OH)_2$), copper diacetate ($Cu(CH_3COO)_2$) or the like.

A neutralization degree of the carboxylic acid group by copper ion may preferably be 5 to 30 mol %, more preferably 10 to 20 mol % based on the total carboxylic groups in the alkali metal ion-neutralized ionomer resin, that is the amount of carboxylic acid groups present in the base copolymer of the alkaline metal ion-neutralized ionomer resin. If the neutralization degree is less than 5 mol %, the technical effects of the addition of copper ion are not sufficient. If it is more than 30 mol %, the technical effects of the presence of sodium ion do not sufficiently exhibit. A neutralization degree of the carboxylic acid group by alkali metal ion may be 10 to 60 mol %, particularly 20 to 40 mol %, based on the amount of carboxylic acid groups present in the base copolymer of the alkali metal ion-neutralized ionomer resin. A neutralization degree of the carboxylic acid group by both copper ion and alkali metal ion may be preferably 30 to 70 mol %, more preferably 40 to 60 mol %, based on the amount of carboxylic acid groups present in the base copolymer of the alkali metal ion-neutralized ionomer resin.

The dual ion ionomer of the present invention may be prepared by mixing the alkali metal ion-neutralized ionomer resin and the copper ion source in molten condition, especially at a temperature of 150 to 300° C. The neutralization reaction between the carboxylic acid group and copper ion can be ascertained by the reduction of an absorption between 1690 to 1700 $cm^{-1}$ according to the absorption of —COOH in infrared absorption spectrum (film method) of the reaction product. When the neutralization reaction is terminated, the resin would change its appearance from milky white to transparent. An X ray analysis may confirm that copper ion is uniformly dispersed in the ionomer resin.

The dual ion ionomer is contained in the base resin of the inner cover layer in an amount of 10 to 100% by weight, preferably 30 to 100% by weight. Amounts of less than 10% by weight do not sufficiently exhibit the technical effects of the dual ion ionomer. When the inner cover is formed from, as base resin, a mixture of the dual ion ionomer and another resin, the other resin can be one which has been used for the cover of the golf balls, and include conventional ionomer (such as Hi-Milan 1605 (Na), Hi-Milan 1706 (Zn), Hi-Milan 1855 (Zn) or Hi-Milan AD852 (Mg), in which the letters in the parentheses, i.e. Na, Zn and Mg, indicate sorts of metal ion to be neutralized); terpolymer of ethylene, methacrylic acid and unsaturated carboxylic ester; maleic anhydride-modified olefinic copolymer; glycidyl group-containing olefinic copolymer and the like.

In addition to the base resin containing at least 10% by weight of the dual ion ionomer, the inner cover layer may contain, if necessary, filler, dispersant, pigment and the like. The inner cover may adjust its specific gravity to not less than 1.2, for enhancing moment of inertia. The inner cover may have a thickness of 1 to 3 mm. Thickness of less than 1 mm does not sufficiently exhibit the technical effects of the presence of the inner cover layer and that of more than 3 mm would deteriorate the shot feel of the resulting golf balls.

The solid core used in the present invention can be any one that has been used for solid golf balls, but includes a vulcanized article formed from a rubber composition mainly containing polybutadiene rubber by a conventional method. It is preferred that the solid core has a deformation amount of 3 to 6 mm, when applying a load of from 10 Kgf to 130 Kgf onto the core. When the deformation amounts is less than 3 mm, the core is too hard and deteriorates the shot feel of the resulting golf balls. When it is more than 6 mm, the core is too soft and reduces the rebound characteristics of the golf ball to result in poor flight distance. It is also preferred that the core has a diameter of 30 to 40 mm. If the diameter is outside this range, the cover thickness is not sufficient and deteriorates the physical properties of the resulting golf ball.

On the inner cover layer covering the solid core, the outer cover layer is formed. The outer cover can be any one that has been used for a cover of golf balls. The outer cover layer preferably has a thickness of 1 to 3 mm. Thickness of less than 1 mm does not sufficiently exhibit the technical effects of the presence of the outer layer and that of more than 3 mm does not sufficiently exhibit the technical effects of the presence of the inner layer and the core.

The three piece solid golf ball of the present invention will be explained with reference to FIG. 1. FIG. 1 shows a cross-sectional view of one embodiment of the three piece solid golf ball of the present invention. In FIG. 1, 1 indicates a solid core, and 2 shows an inner cover covering the solid core 1. The number 3 indicates an outer cover covering the inner cover 2, and 3*a* indicates dimples.

The solid core 1 is not limited to the specific one but includes a vulcanized article formed from a rubber composition mainly containing polybutadiene rubber. It is preferred that the core has a diameter of 30 to 40 mm and has a deformation amount of 3 to 6 mm, when applying a load of from 10 Kgf to 130 Kgf onto the core.

The inner cover 2 employs the dual ion ionomer neutralized with both copper ion and alkali metal ion. The inner cover comprises a base resin and an additive, and the base resin comprises at least 10% by weight of an ionomer resin having carboxylic groups of which 10 to 60 mol % is neutralized with alkaline metal ion and of which 5 to 30 mol % is neutralized with copper ion, a total mol % of the neutralized carboxylic group being 30 to 70 mol %. The inner cover layer preferably has a thickness of 1 to 3 mm.

The outer cover 3 covers the inner cover 2 and is not limited to specific one, but has a thickness of 1 to 3 mm. The dimples 3*a* are arranged on the outer cover 3 with suitable number according to the desired performance, if necessary. The three piece solid golf ball may generally have paint layer and marking thereon.

EXAMPLES

The present invention will be explained with reference to Examples, which, however, are not to be construed as limiting the invention to their details.

Examples 1 to 4 and Comparative Example 1 to 4

Golf balls of Examples 1 to 4 and Comparative Example 1 to 4 were prepared by the following (1) to (4).

(1) Preparation of solid core

Three rubber compositions shown in Table 1 were vulcanized at 150° C. for 30 minutes under pressure to form three solid cores I, II and III having a diameter 35.3 mm. In Table 1, the number indicating formulating amounts of ingredients is based on parts by weight. In the other Tables, the number is based on parts by weight for formulating amounts.

The resulting solid cores were subjected to the determination of weight, diameter and deformation amount and their results are shown in Table 1. The deformation amount is determined by applying a load of 10 Kgf to 130 Kgf on the core and measuring a deformation of the core.

TABLE 1

| | Solid core | | |
|---|---|---|---|
| | I | II | III |
| Ingredients | | | |
| BR-18 *1 | 100 | 100 | 100 |
| Zinc acrylate | 25 | 20 | 30 |
| Zinc oxide | 18 | 20 | 20 |

TABLE 1-continued

| | Solid core | | |
|---|---|---|---|
| | I | II | III |
| Dicumyl peroxide | 1.5 | 1.5 | 1.5 |
| Yoshinox 425 *2 | 0.5 | 0.5 | 0.5 |
| Diphenyl disulfide | 0.5 | 0.5 | 0 |
| Weight (g) | 26.0 | 26.1 | 34.8 |
| Diameter (mm) | 35.3 | 35.3 | 38.1 |
| Deformation amount (mm) | 4.0 | 5.5 | 2.8 |

*1 Polybutadiene commercially available from JSR Co., Ltd.
*2 Antioxidant commercially available from Yoshitomi Pharmaceutical Co., Ltd.

(2) Preparation of inner cover composition

Ionomer and copper dihydroxide were mixed in the amounts shown in Table 2 in a twin screw extruder and pelletized by a pelletizer to form blue-green pelletized dual ion ionomers X and Y. The extruding conditions were a screw diameter of 45 mm, a screw rotation of 250 rpm, a screw LID of 30 and a die temperature of 250° C.

TABLE 2

| | Dual ion ionomer | |
|---|---|---|
| | X | Y |
| Hi-Milan 1605 *3 | 100 | 0 |
| HI-Milan 1856 *4 | 0 | 100 |
| Copper dihydroxide | 1.2 | 1.2 |

*3 Ethylene-methacrylic acid copolymer ionomer having a carboxylic acid content of about 15% by weight, a sodium ion neutralization degree of about 30 mol % and a flexural modulus of 370 MPa, available from Mitsui Du Pont Polychemical Co., Ltd.
*4 Ethylene-butylacrylate-methacrylic acid terpolymer ionomer having a carboxylic acid content of about 10% by weight, a sodium ion neutralization degree of about 36 mol % and a flexural modulus of 70 MPa, available from Mitsui Du Pont Polychemical Co., Ltd.

The resulting dual ion ionomer X had a copper ion neutralization degree of about 15 mol % and a sodium ion neutralization degree of about 30 mol % and a neutralization degree of both copper ion and sodium ion of about 45 mol %. The resulting dual ion ionomer Y had a copper ion neutralization degree of about 15 mol % and a sodium ion neutralization degree of about 36 mol % and a neutralization degree of both copper ion and sodium ion of about 51 mol %.

The dual ion ionomers X and Y were used to form inner cover resin compositions. The formulations A to E shown in Table 3 were mixed in a twin screw extruder and pelletized to form inner cover resin compositions A to E in pellet shape. The hardness (Shore D hardness) and specific gravity of the inner cover resin compositions were evaluated and the results are also shown in Table 3.

TABLE 3

| | Inner cover resin composition | | | | |
|---|---|---|---|---|---|
| | A | B | C | D | E |
| Dual ion ionomer X | 100 | 50 | 0 | 0 | 0 |
| Dual ion ionomer Y | 0 | 0 | 50 | 0 | 0 |
| Hi-Milan 1605 | 0 | 0 | 0 | 100 | 50 |
| Hi-Milan 1706 *5 | 0 | 5 | 50 | 0 | 0 |
| Hi-Milan 1855 *6 | 0 | 0 | 0 | 0 | 50 |
| Tungsten | 35 | 35 | 35 | 35 | 35 |

TABLE 3-continued

| | Inner cover resin composition | | | | |
|---|---|---|---|---|---|
| | A | B | C | D | E |
| Hardness (Shore D) | 70 | 69 | 65 | 67 | 65 |
| Specific gravity | 1.31 | 1.30 | 1.30 | 1.30 | 1.30 |

*5 Ethylene-methacrylic acid copolymer ionomer neutralized with zinc ion, having a flexural modulus of 330 MPa, available from Mitsui Du Pont Polychemical Co., Ltd.
*6 Ethylene-butylacrylate-methacrylic acid terpolymer ionomer neutralized with zinc ion, having a flexural modulus of 90 MPa, available from Mitsui Du Pont Polychemical Co., Ltd.

(3) Preparation of outer cover resin composition

The formulations F to H shown in Table 4 were mixed in a twin screw extruder and pelletized to form outer cover resin compositions F to H in pellet shape.

TABLE 4

| | Outer cover resin composition | | |
|---|---|---|---|
| | F | G | H |
| Hi-Milan 1605 | 40 | 50 | 50 |
| Hi-Milan 1706 | 40 | 50 | 0 |
| Hi-Milan 1855 | 20 | 0 | 50 |
| Titanium dioxide | 2 | 2 | 2 |

(4) Preparation of golf balls

Golf balls of Examples 1 to 4 and Comparative Examples 1 and 2

The solid core obtained in the step (1) was covered with the inner cover resin composition obtained in the step (2) by injection molding in a thickness of 1.8 mm, and then the outer cover resin composition obtained in the step (3) was covered thereon by injection molding in a thickness of 1.9 mm. It was then subjected to flash removal and pretreatment for painting and painted to form a three piece solid golf ball having a diameter of 42.7 mm. The combination of the core, inner cover and outer cover resin composition is shown in Tables 5 and 6.

Golf balls of Comparative Example 3 and 4

The solid core obtained in the step (1) was covered with the outer cover resin composition obtained in the step (3) by injection molding to form a cover layer having 3.7 mm. It was then treated as generally described above for the golf balls of Examples 1 to 4 and Comparative Examples 1 and 2 to obtain a two piece solid golf ball having a diameter of 42.7 mm. The combination of the core, inner cover and outer cover resin composition is shown in Table 6.

The resulting golf balls were subjected to a measurement of rebound coefficient and flight distance and also subjected to an evaluation of shot feel when hitting. The measurement and evaluation were conducted as explained as follow.

Rebound coefficient

A stainless steel cylinder having a weight of 198 g was struck out at an initial velocity of 45 m/s using a resilience gun and collided with a golf ball. The velocities of the cylinder and the golf ball immediate after the collision were measured by two phototubes and a rebound coefficient was calculated from the velocities and weights. The rebound coefficient of the golf ball of Comparative Example 1 was fixed 100 and the other rebound coefficients were shown as an index therefrom. The larger the number of rebound coefficient, the higher the rebound coefficient of golf ball and the better the flight performance of golf ball.

Flight distance

A driver (No. 1 wood club) was attached to a swing robot available from True Temper Co. and a golf ball was hit thereby at a head speed of 45 m/s. A carry distance, i.e. a distance from a hitting point to a point firstly reaching the golf ball on the ground, was measured.

Shot feel

Ten professional golfers hit golf balls using a No. 1 wood club and evaluated by the following criteria. Evaluation that more than 5 persons among the professional golfers indicate is shown in Tables 5 and 6.

Criteria

Good

Too hard

Little rebound (poor rebound characteristics)

TABLE 5

| | Examples | | | |
|---|---|---|---|---|
| | 1 | 2 | 3 | 4 |
| Solid core | I | I | I | II |
| Inner cover | A | B | C | B |
| Outer cover | F | F | F | F |
| Rebound coefficient | 102 | 102 | 101 | 101 |
| Flight distance (yards) | 227 | 228 | 226 | 226 |
| Shot feel | Good | Good | Good | Good |

TABLE 6

| | Comparative Examples | | | |
|---|---|---|---|---|
| | 1 | 2 | 3 | 4 |
| Solid core | I | I | III | III |
| Inner cover | D | E | — | — |
| Outer cover | F | F | G | H |
| Rebound coefficient | 100 | 98 | 102 | 98 |
| Flight distance (yards) | 224 | 221 | 228 | 220 |
| Shot feel | Little rebound | Little rebound | Too hard | Little rebound |

As is apparent from Table 5, the golf balls of Examples 1 to 4 show longer flight distance, such as 226 to 228 yards, thus show good flight performance and also show good shot feel. The inner cover of the golf ball of Example 1 contains a base resin that is formed from the dual ion ionomer neutralized with both copper ion and sodium ion. The inner covers of the golf balls of Examples 2 to 4 contain a base resin that is a mixture of the dual ion ionomer and the other ionomer.

On the other hand, the golf ball of Comparative Example 1 in which the inner cover contains a base resin of sodium ion neutralized rigid ionomer, Hi-Milan 1605, does not show sufficient rebound performance, thus shorter flight distance than those of Examples 1 to 4, and exhibits poor in shot feel as little rebound. The golf ball of Comparative Example 2, in which the inner cover contains a base resin of a mixture of rigid ionomer, i.e. Hi-Milan 1605, and soft ionomer, i.e. Hi-Milan 1855, deteriorates flight distance because of the use of the soft ionomer, and also show poor shot feel as little rebound. The two piece golf ball of Comparative Example 3, in which no inner cover is present and the outer cover is formed from high rigid ionomer, exhibits excellent flight distance, but shows poor shot feel as too hard. The two piece golf ball of Comparative Example 4, in which no inner cover is present and the outer cover is formed from a mixture of high rigid ionomer and soft ionomer, exhibits shorter flight distance and poor shot feel as little rebound.

What is claimed is:

1. A three piece solid golf ball comprising a solid core, an inner cover covering the solid core and an outer cover covering the inner cover, wherein said inner cover comprises a base resin and an additive, and said base resin comprises at least 10% by weight of a dual ionomer resin having carboxylic groups of which 10 to 60 mol % is neutralized with alkali metal ion and of which 5 to 30 mol % is neutralized with copper ion, a total mol % of the neutralized carboxylic group being 30 to 70 mol %, and wherein said outer cover is not made up of a dual ionomer resin.

2. The three piece solid golf ball according to claim 1 wherein the alkali metal ion is sodium ion.

3. The three piece solid golf ball according to claim 1 wherein the solid core has a deformation amount of 3 to 6 mm, when applying a load of from 10 Kgf to 130 Kgf on the solid core.

4. The three piece solid golf ball according to claim 1 wherein the dual ionomer resin is prepared from an alkali metal ion-neutralized ionomer by partially neutralizing the remaining free carboxylic acid groups present in the ionomer with copper ion.

5. The three piece solid golf ball according to claim 4 wherein the alkali metal ion-neutralized ionomer is a terpolymer of α-olefin, α,β-unsaturated carboxylic acid and α,β-unsaturated carboxylic ester, of which 10 to 60 mol % of carboxylic groups is neutralized with alkali metal ion.

6. The three piece solid golf ball according to claim 1 wherein the outer cover has a thickness of 1 to 3 mm.

7. The three piece solid golf ball according to claim 1 wherein the base resin is a mixture of:

(a) at least 10% by weight of a dual ionomer resin having carboxylic groups of which 10 to 60 mol % is neutralized with alkali metal ion and of which 5 to 30 mol % is neutralized with copper ion, a total mol % of the neutralized carboxylic group being 30 to 70 mol %, and (b) an ionomer resin other than the dual ionomer resin (a).

8. The three piece solid golf ball according to claim 1 wherein the additive is selected from the group consisting of filler, dispersant, pigment and a mixture thereof.

9. The three piece solid golf ball according to claim 1 wherein the inner cover has a specific gravity of not less than 1.2.

10. The three piece solid golf ball according to claim 1 wherein the inner cover has a thickness of 1 to 3 mm.

11. The three piece solid golf ball according to claim 1 wherein the solid core has a diameter of 30 to 40 mm.

* * * * *